US005333922A

United States Patent [19]

Jones

[11] Patent Number: 5,333,922

[45] Date of Patent: Aug. 2, 1994

[54] PORTABLE DOOR SECURE SYSTEM

[76] Inventor: William L. Jones, 660 N. Main St., LaGrange, Tex. 78945

[21] Appl. No.: 94,236

[22] Filed: Jul. 21, 1993

[51] Int. Cl.[5] ..... E05C 17/54

[52] U.S. Cl. ..... 292/339

[58] Field of Search ..... 292/262, 338, 339, DIG. 46; 285/321; 403/332, 361

[56] References Cited

U.S. PATENT DOCUMENTS

| | | | |
|---|---|---|---|
| 3,830,008 | 8/1974 | Johnson | 403/361 |
| 4,019,765 | 4/1977 | Nichola | 292/338 |
| 4,607,253 | 8/1986 | Wooten et al. | 292/339 X |
| 4,722,634 | 2/1988 | Molish | 403/361 X |
| 4,819,296 | 4/1989 | Wilkins | 292/339 X |
| 4,971,374 | 11/1990 | Lovell et al. | 292/339 |
| 5,056,836 | 10/1991 | Wells | 292/339 X |
| 5,064,232 | 11/1991 | Quarberg | 292/339 |

FOREIGN PATENT DOCUMENTS

| | | | |
|---|---|---|---|
| 2102495A | 2/1983 | United Kingdom | 292/339 |

*Primary Examiner*—Lindsey Rodney M.
*Attorney, Agent, or Firm*—Richard L. Miller

[57] ABSTRACT

A portable door secure system which consists of an elongate shank with a foot component coupled to a lower end of the shank for engaging a floor in front of a door and a yoke component coupled to an upper end of the shank for engaging an underside of a door knob on the door. The shank can be positioned at an angle between the door knob and the floor, to jam the door closed to prevent the door from being opened inwardly toward the side on which the device resides. The device disassembles into a very small compact light weight set of components so that it may easily be carried by a user typically a hotel or motel patron.

2 Claims, 1 Drawing Sheet

PORTABLE DOOR SECURE SYSTEM

BACKGROUND OF THE INVENTION

The instant invention relates generally to door stops and more specifically it relates to a portable door secure system.

Numerous door stops have been provided in prior art that are adapted to be used on entry doors to hold the doors closed, so as to prohibit the unauthorized opening of the doors. For example, U.S. Pat. Nos. 1,966,612 to Cochran; 4,456,291 to Brogie and 5,040,835 to Barker all are illustrative of such prior art. While these units may be suitable for the particular purpose to which they address, they would not be as suitable for the purposes of the present invention as heretofore described.

SUMMARY OF THE INVENTION

A primary object of the present invention is to provide a portable door secure system that will overcome the shortcomings of the prior art devices.

Another object is to provide a portable door secure system that can be positioned at any angle between a door knob and a floor to jam the door closed, so as to prevent the door from being opened.

An additional object is to provide a portable door secure system that is completely removable therefrom when it is not being used, so as to offer no obstruction to the normal movement of the door when being opened.

A further object is to provide a portable door secure system that is simple and easy to use, which is ideal for patrons and guessed at hotels, motels and in general the travelling public.

A still further object is to provide a portable door secure system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The figures on the drawings are briefly described as follows.

DETAILED DESCRIPTION OF THE PREFERRED EMBODIMENTS

Figure 1:
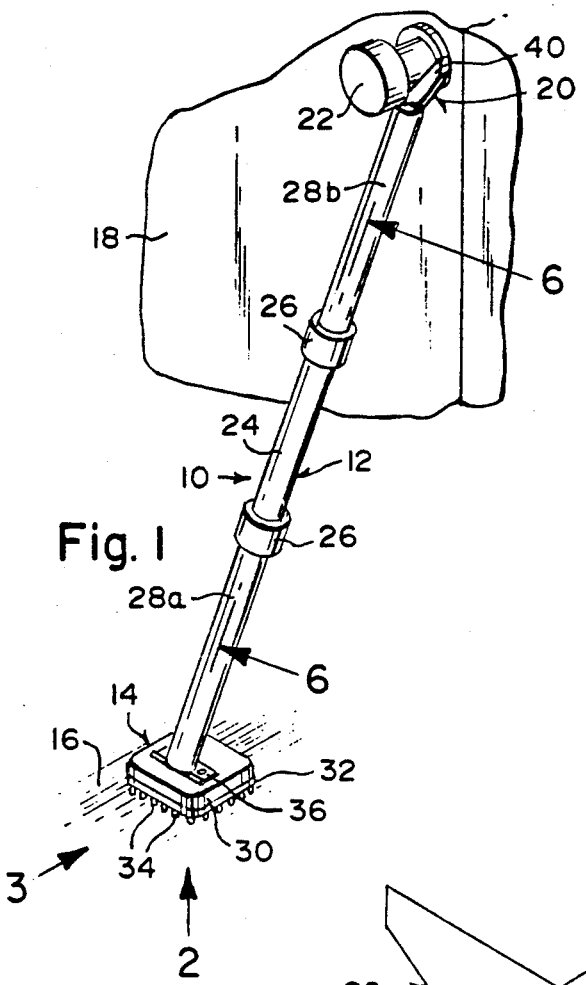
FIG. 1 is a diagrammatic perspective view illustrating the instant invention in use jamming a door closed.

Turning now descriptively to the drawings, in which similar reference characters denote similar elements throughout the several views, FIG. 1 illustrates a portable door secure system 10 which consists of an elongate shank 12, with a component 14 coupled to a lower end of the shank 12, for engaging floor 16 in front of a door 18. Another component 20 is coupled to an upper end of the shank 12, for engaging an underside of a door knob 22 on the door 18. The shank 12 can be positioned at an angle between the door knob 22 and the floor 16, to jam the door 18 closed to prevent the door 18 from being opened inwardly into the area where the device resides.

Figure 6:
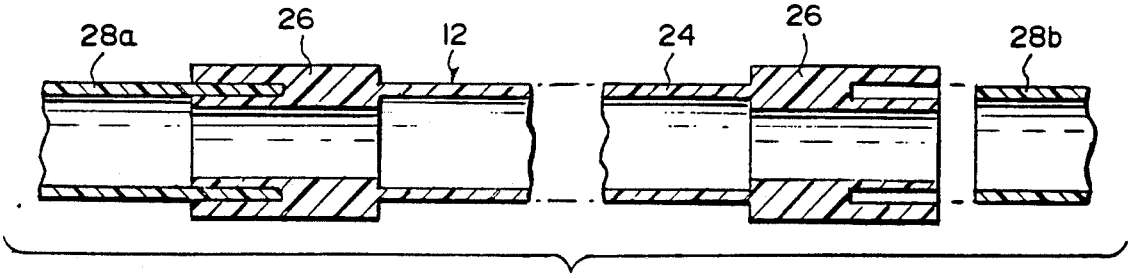
FIG. 6 is an exploded cross sectional view with parts broken away taken on line 6—6 in FIG. 1, illustrating the shank construction of the instant invention.

The elongate shank, as best seen in FIG. 6, includes a central pipe 24 having a collar 26 at each end. A pair of pipes **28*a*, 28*b* are also provided. Each pipe 28*a* and 28*b* is assembled at one end with one collar 26 on the central pipe 24, so that the elongate shank 12** can be disassembled into three basic portions for storage when not in use and compactness when transport same.

Figure 2:
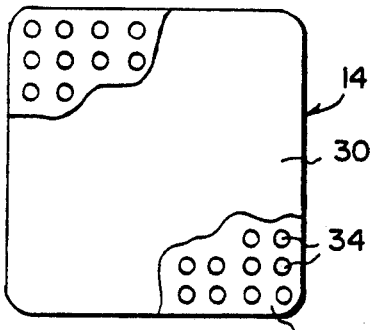
FIG. 2 is a diagrammatic elevational view with parts broken away taken in the direction of arrow 2 in FIG. 1.
Figure 3:
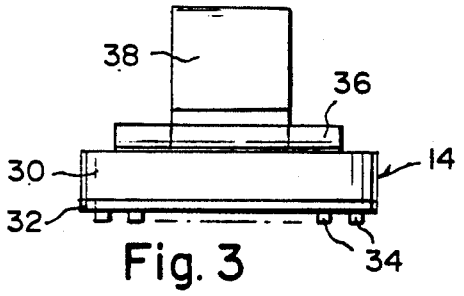
FIG. 3 is a diagrammatic elevational view taken in the direction of arrow 3 in FIG. 1, of just the floor engagement component of the instant invention per se.

The floor engaging component 14, as best seen in FIGS. 1, 2 and 3 contains a foot member 30, with a non-skid pad 32 having a plurality of projections 34 thereon mounted to the underside of the foot member 30, for frictional engagement upon the floor 16. A hinge 36 mounted to the top surface of the foot member 30 has a tongue 38 for insertion into the lower end of the bottom pipe **28*a*, to allow the projections 34 on the non-skid pad 32 on the foot member 30 to sit flat upon the floor 16**.

Figure 4:
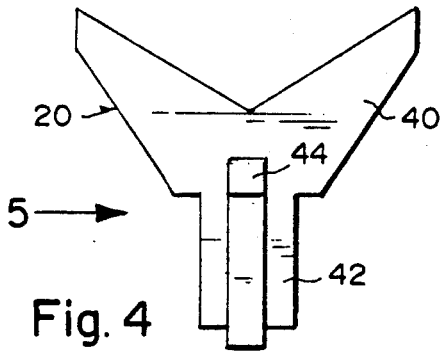
FIG. 4 is a diagrammatic elevational view of just the door knob engaging component of the instant invention per se.
Figure 5:
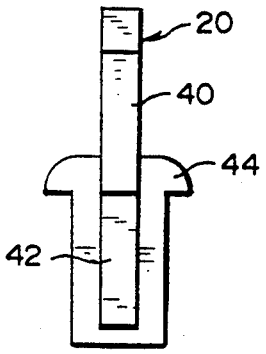
FIG. 5 is a side elevational view taken in the direction of arrow 5 in FIG. 4.

The door knob engaging component 20, as best seen in FIGS. 4 and 5, is a Y-shaped yoke member 40 having a stem 42 with a stop abutment 44 thereon, for insertion into the upper end of the top pipe **28*b*. The yoke member 40 can bear against the underside of the door knob 22**. The construction thus illustrated allow the device to be fabricated typically out of either strong plastic or relatively light wight metal components so that when disassembled the resulting set of components are quite compact, light and easily transported by the user.

OPERATION OF THE INVENTION

To use the portable door secure system 10 a person simply inserts the ends of the pipes **28*a* and 28*b* into each collar 26 on the central pipe 24. The tongue 38 of the hinge 36 is then inserted into the lower end of the bottom pipe 28*a*. The stem 42 of the yoke member 40 is then inserted up to the abutment 44 into the upper end of the top pipe 28*b*. The yoke member 40 is placed up against the underside of the door knob 22 on the inwardly opening side of the door 18. The shank 12 now extends at an angle therefrom, so that the projections 34 on the non-skid pad 32 can sit flat upon the floor 16, to jam the door 18** closed and preventing intruders pushing the door inwardly and thereby entering the area thus protected.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A portable door secure system which comprises:

a) an elongate shank comprising a central pipe integrally formed with a collar at each end, each collar being formed with an annular channel section socket, having a channel mouth opening to a respective end; and a pair of pipes, each pipe being assembled at one end with one said collar on said central pipe by receipt as a snug fit in a respective socket, so that said elongate shank can be disassembled into three basic portions for storage when not in use by pulling each of said pair of pipes, from a respective collar on said central pipe;

b) means coupled to a lower end of said shank for engaging a floor in front of a door and comprising a foot member;

a non-skid pad having a plurality of projections thereon mounted to the underside of said foot member for frictional engagement upon the floor; and a hinge mounted to the top surface of said foot member having a tongue for insertion into the lower end of said bottom pipe to allow said projections on said non-skid pad on said floor member to sit flat upon the floor; and c) means coupled to an upper end of said shank for engaging an underside of a door knob on the door and comprising a Y-shaped yoke member having a stem with a stop abutment thereon for insertion into the upper end of said top pipe, so that said yoke member can bear against the underside of the door knob, whereby said shank can be positioned at an angle between the door knob and the floor, to jam the door closed to prevent the door from being opened inwardly toward the area in which said portable door secure system resides.

2. A portable door secure system according to claim 1 wherein the central pipe and pair of pipes are made of plastic.

* * * * *